US005337453A

United States Patent [19]

Bargesser

[11] Patent Number: 5,337,453

[45] Date of Patent: Aug. 16, 1994

[54] BUTT HINGE PIN LOCK

[76] Inventor: Walter R. Bargesser, 8808 N. 20th St., Tampa, Fla. 33604

[21] Appl. No.: 8,900

[22] Filed: Jan. 19, 1993

[51] Int. Cl.[5] ..... F05D 5/12

[52] U.S. Cl. ..... 16/380

[58] Field of Search ..... 16/380, 381, 262, 263, 16/223

[56] References Cited

U.S. PATENT DOCUMENTS

| | | | |
|---|---|---|---|
| 73,120 | 1/1868 | Reiber | 16/381 |
| 926,949 | 7/1909 | Maas | 16/380 |
| 1,109,074 | 1/1914 | Lamon | 16/380 |
| 1,865,052 | 6/1932 | Wolters | 16/380 |
| 2,566,486 | 9/1951 | Gawlik | 16/380 |
| 2,814,498 | 11/1957 | Hull | 280/43.24 |
| 2,998,898 | 9/1961 | Gerr et al. | 16/380 |
| 3,263,269 | 8/1966 | McGahee | 16/380 |

FOREIGN PATENT DOCUMENTS

| | | | |
|---|---|---|---|
| 8900786 | 10/1990 | Netherlands | 16/380 |

*Primary Examiner*—Powell A. Larson
*Assistant Examiner*—Donald M. Gurley

[57] ABSTRACT

A butt hinge pin lock is provided for securing standard butt hinges against tampering, by removal of the hinge pins. The device described herein is attached to the door, in a manner, and location, that interferes with the removal of the hinge pins by unauthorized persons. It consists of a locking member, which is mounted on the door, using two or more tamper resistant bolts, and employs hardware on the inside of the door, that allows the device to be easily removed from the inside of the room, when necessary. No modifications to the hinges are required, and modifications to the door consist only in the drilling of access holes for the mounting hardware of the invention.

1 Claim, 2 Drawing Sheets

BUTT HINGE PIN LOCK

BACKGROUND OF INVENTION

This invention relates to an apparatus and method of securing the pins of a standard butt hinge against tampering, or removal by intruders, or vandals. It provides a method of protecting these hinge pins from unwanted removal from the butt hinge bore, with no modifications to the hinges themselves, and with only minor modifications to the door.

It has been customary to install both inside and outside doors using butt hinges, also known as leaf and knuckle hinges. These hinges, which are well known in the prior arts, have two leaves, one being attached to the door, and the other being attached to the door jamb, in a mating location, and position. Each leaf has one or more generally cylindrical knuckles, which knuckles being spaced apart from one another, are designed to mesh with the spaced knuckles on the opposite leaf. These two sets of knuckles have a central axial bore, and are aligned coaxially by a pin, which fits into the bore of the knuckles, and maintains the assembly of the leaves in a rotatable configuration with respect to the axis of the bore of the butt hinge.

While butt hinges are convenient for mounting doors, they are vulnerable to tampering by intruders. Doors using this type of hinge can easily be removed, even if locked, by simply driving downward, or pulling upward, the hinge pins out of the bore, formed by the knuckles on the two hinge leaves. Once the pins are removed, the door can be lifted out of position, and entry can be gained to the room, or building. This drawback makes standard butt hinges unsuitable for applications in which security is an important consideration.

Several approaches have been taught in the prior arts to improve the security of butt hinges. One approach is taught by Wilman, in U.S. Pat. No. D277,453, whereby a hinge pin is permanently attached to the end of the pin, and then attached to the door, or door jamb, using a screw, or other device. This method is inconvenient, and relatively expensive, because it requires a complex modification to the hinge pin, with the lock being installed by welding, or some other permanent method. There is also a danger of the device being pried loose, since it is not flush with the surface of the door, at all points. This would allow a vandal to drive the hinge pin out, thereby defeating the purpose of the lock.

Another approach is taught by Lawrence, in U.S. Pat. No. 4,116,514. This Patent teaches a security hinge having two pins installed in the bore from opposite directions, each of these pins having a head, or end cap, larger than the diameter of the pin. The bore, formed by the knuckles of this hinge is fitted with bearings, or spacers, that do not allow the pin heads to be driven through. A second set of end caps is also provided to fully enclose the ends of the bore, thus making the shorter inner pins relatively inaccessible. This approach is more secure than the standard single pin design, however, a problem exists, in that it makes the removal of the hinge difficult for anyone lacking the proper training, and tools. It is also a complex, and therefore expensive, variation on the standard hinge design.

Still another approach is taught in the art of Bentley, in U.S. Pat. No. 4,123,822, wherein a pinless hinge is installed on, or formed into, a door. This approach eliminates the hinge pin, thereby making the usual method of tampering impossible. However, using this type of hinge involves a complete replacement of the hinge mechanism, and can require significant modifications to the door, the door jamb, or both. In addition, this design is susceptible to prying and offers less strength for its size than the conventional butt hinge.

SUMMARY OF THE INVENTION

Accordingly, it is an object of this invention to provide a device that can be installed onto a door already equipped with standard butt hinges, for the purpose of significantly improving the security of these existing hinges.

Another object of this invention is to provide a device that is easily installable by persons having no special training and no special tools.

Still another object of this invention is to provide a device that offers improved security, while also being quickly and easily removeable, in order that the door can be removed by authorized persons from the inside of the room, when necessary.

Yet another object of this invention is to provide a device that is simple, and inexpensive, in order that it is practical for use in a wide variety of applications. In carrying out this invention in the illustrative embodiment thereof, a butt hinge pin is provided, consisting of a strip or block of a durable material, having a more or less 90 degree bend at one end of the strip of material. This lock is intended to be mounted on a door, directly above the hinge pin, and abutted against the hinge pin, as required, to form a stop for the head of the hinge pin.

This lock is constructed so that its thickness, at least on the end covering the hinge pin, is sufficient to prevent the pin from being driven through the bore of the hinge, either upwardly, or downwardly, and removed. The lock also extends beyond the edge of the door, so that the pin cannot be pushed past it in the direction of the door's axis of rotation.

This lock is also provided with at least two mounting holes, in order that it can be mounted securely on the door, and cannot be rotated out of position. The surfaces of the locking device are smooth, so that the lock can be mounted flush with the door, thus making prying an ineffective method of dislodging it from the door.

Now, accepting holes are drilled through the door, and the block, or plate, forming the locking member is attached to the door, by means of carriage bolts, or other similar fasteners being inserted through the drilled accepting holes, so that only the heads of the bolts are visible from the outside of the door. This prevents the bolts from being loosened by an intruder using ordinary hand tools. On the inside of the door, the carriage bolts are secured in position by use of flat washers and wing nuts, or equivalent hardware, so that the lock can be tightly installed on the inside of the door, but easily removed, should it become necessary for authorized persons to disassemble the hinges.

Conveniently, the user may convert an ordinary butt hinged door into a secure door, by drilling two holes in the door, inserting the invention over the hinge pin, and inserting two carriage type bolts through access holes in the invention, on through the holes drilled in the door, and secure the invention to the door, using wing nuts on the ends of the carriage bolts on the inside of the door, thusly securing the hinge pins in place.

BRIEF DESCRIPTION OF THE DRAWINGS

This invention, together with other objects, features, aspects and advantages thereof, will be more clearly understood from the following description, considered in conjunction with the accompanying drawings.

Two sheets of drawings are furnished, sheet one contains FIG. 1 and sheet 2 contains FIG. 2, and FIG. 3.

DESCRIPTION OF THE PREFERRED EMBODIMENTS

Figure 1:
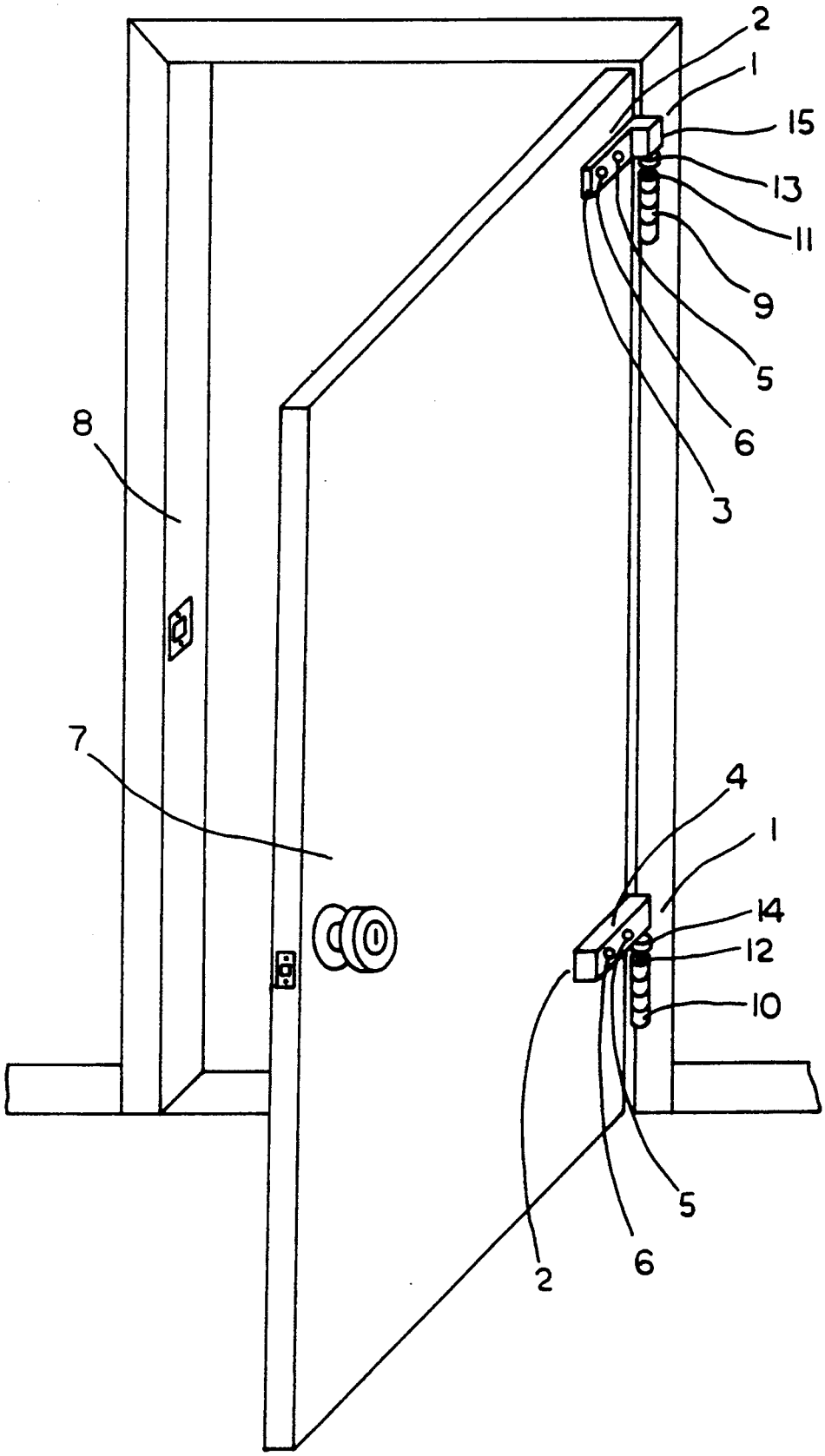
FIG. 1 is an isometric representation of the invention, showing how two alternative embodiments of the invention would be attached above the hinge pin of the door.

Referring now to FIG. 1, a butt hinge pin lock, referred to generally by the reference numeral 1, is made of suitable material, and comprises a locking member 2, which could have several equivalent embodiments, including plate 3, or block 4. Butt hinge pin lock 1 also includes mounting bolts 5, and 6, and suitable mounting hardware to be described later in this section.

Now, butt hinge pin lock 1 is installed on door 7, door 7 being rotatably affixed to door jamb 8, using butt hinges 9, and 10. Butt hinges 9, and 10 are held together rotatably by hinge pins 11, and 12, having heads 13, and 14, the diameters of which are larger than those of pins 11, and 12. In some cases, a straight pin is used, and protective caps are installed in the bore of the hinge knuckles.

Figure 2:
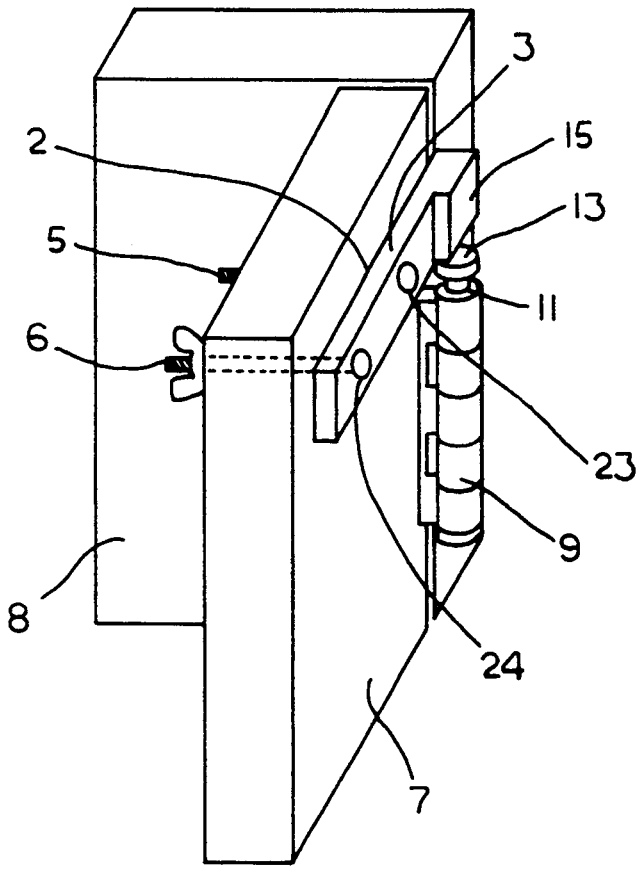
FIG. 2 is a cutaway view of the door, and the door jamb, with a view of the invention installed above the hinge pin of the hinge, showing the features in greater detail.

Now, and referring to FIG. 2, locking member 2 is affixed to the outer surface of door 7 so that it extends over head 13 of hinge pin 11. In the embodiment shown in FIG. 2, plate 3 is constructed with a raised surface 15, to ensure that it will not be possible to drive pin 11 past locking member 2, in that case, thusly defeating the purpose of the lock. Locking member 2 also extends slightly beyond the interior edge of door 7, so that pin 11 cannot be driven between raised surface 15 and door jamb 8.

Figure 3:
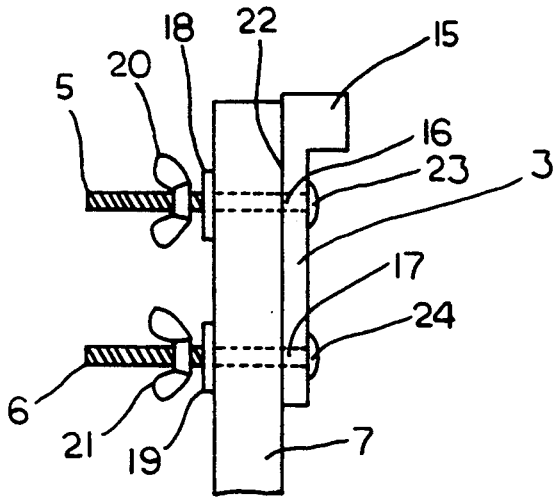
FIG. 3 is a top view of the invention, showing the mounting hardware method.

Progressing now to FIG. 3, we see a top view of plate 3, showing mounting holes 16, and 17, through which mounting bolts 5, and 6 are installed. Bolts 5, and 6 are secured on the inside of door 7 using washers 18, and 19, and wing nuts 20, and 21. The surfaces of plate 3, and especially inside surface 22, are made smooth, so that plate 3 will mount against door 7 in a flush manner, and so that ordinary tools cannot be easily used to pry plate 3 away from door 7. In addition, bolts 5, and 6 have rounded heads 23, and 24, which further protect against removal of plate 3 by unauthorized persons.

Accordingly, a very unique, attractive, convenient method and apparatus are provided for improving the security of butt hinges, by preventing the hinge pins from being driven, or pulled out, while still allowing the lock to be easily removed from the inside of the room, when desired by the owner.

Since minor changes and modifications varied to fit particular operating requirements and environments will be understood by those skilled in the art, the invention is not considered limited to the specific examples chosen for purposes of illustration, and includes all changes and modifications which do not constitute a departure from the true spirit and scope of this invention as claimed in the following claims and reasonable equivalents to the claimed elements.

What is claimed is:

1. A butt hinge pin lock securing a butt hinge pin in place on a door, comprising:

a flat piece of material, said flat piece of material having means affixing it to a door having a butt type hinge installed thereon, said affixing means including mounting holes extending through said flat piece of material and means extending through said mounting holes and door affixing said flat piece of material in a horizontal position on said door, said flat piece of material having at one end thereof a thicker portion extending substantially 90 degrees from said flat piece of material and positioned directly above a said head of said hinge pin, said thicker portion extending over the head of said hinge pin and thereby preventing said hinge pin from being removed from said butt hinge.

* * * * *